US009839276B2

(12) United States Patent
Yun

(10) Patent No.: US 9,839,276 B2
(45) Date of Patent: Dec. 12, 2017

(54) NAIL CLIPPER WITH ADJUSTABLE CUTTING JAW

(71) Applicant: Woo Sung Yun, Newington, CT (US)

(72) Inventor: Woo Sung Yun, Newington, CT (US)

( * ) Notice: Subject to any disclaimer, the term of this patent is extended or adjusted under 35 U.S.C. 154(b) by 61 days.

(21) Appl. No.: 15/191,845

(22) Filed: Jun. 24, 2016

(65) Prior Publication Data

US 2017/0065052 A1 Mar. 9, 2017

Related U.S. Application Data

(60) Provisional application No. 62/214,191, filed on Sep. 3, 2015.

(51) Int. Cl.
*A45D 29/00* (2006.01)
*A45D 29/02* (2006.01)

(52) U.S. Cl.
CPC ..... *A45D 29/02* (2013.01)

(58) Field of Classification Search
CPC ..... A45D 29/02; Y10T 403/32008; Y10T 403/32073; Y10T 403/32451; Y10T 403/32459
USPC ..... 30/28
See application file for complete search history.

(56) References Cited

U.S. PATENT DOCUMENTS 3,179,071 A * 4/1965 Johnston ..... A47B 9/14 108/139
3,555,675 A * 1/1971 Jurena ..... A45D 29/02 30/28
3,964,798 A * 6/1976 Burleigh ..... B60R 22/201 280/801.2
4,225,185 A * 9/1980 Krzok ..... B60R 22/201 280/801.1
4,648,415 A * 3/1987 Yuan ..... A45D 29/023 132/73
5,011,174 A * 4/1991 Ross-Clunis ..... B62K 19/36 248/161
5,072,511 A * 12/1991 Ro ..... A45D 29/023 132/75
5,261,160 A * 11/1993 Castagna ..... A45D 29/023 132/75
6,273,384 B1 * 8/2001 Hallmark ..... A47C 7/402 248/297.31
6,904,683 B2 * 6/2005 Shinoda ..... A45D 29/02 132/75.5
6,976,310 B1 * 12/2005 Sim ..... A45D 29/023 132/75.5

(Continued)

*Primary Examiner* — Ghassem Alie
*Assistant Examiner* — Bharat C Patel
(74) *Attorney, Agent, or Firm* — Park & Associates IP Law, P.C.

(57) ABSTRACT

A nail clipper includes a clipper body with a pair of jaws, an operating lever configured to move the jaws to cut nails, a hook member mounted to the clipper body, the hook member including a vertical groove portion extending vertically downwardly from an upper surface of the hook member, and first and second lateral groove portions extending in lateral direction from the vertical groove. The operating lever includes a front tip portion of generally bar or shaft shape, which is configured to be inserted through the vertical groove portion of the hook member and to couple with a selected one of the first and second lateral groove portions of the hook member to set a desired gap size of the matching jaw portions of the clipper body.

5 Claims, 3 Drawing Sheets

(56) References Cited

U.S. PATENT DOCUMENTS

| | | | | |
|---|---|---|---|---|
| 7,020,964 | B2 * | 4/2006 | Han | A45D 29/02 132/75.5 |
| 8,056,870 | B2 * | 11/2011 | Chih | F16M 11/24 248/157 |
| 2010/0257740 | A1 * | 10/2010 | Wu | A45D 29/02 30/28 |

* cited by examiner

NAIL CLIPPER WITH ADJUSTABLE CUTTING JAW

REFERENCE TO RELATED APPLICATIONS

This application claims the priority benefit of U.S. Provisional Patent Application No. 62/214,191 filed on Sep. 3, 2015, the entire contents of which are incorporated herein by reference.

FIELD OF THE INVENTION

The present invention relates to a nail clipper having a gap-adjustable cutting jaw capable of adjusting the gap of the upper and lower jaws so as to allow the user to cut nail having a wider thickness range.

BACKGROUND OF THE INVENTION

Nail clippers typically include first and second plate members of metal material that are joined together at one end, and having a pair of jaw portions at the opposite end thereof, and an operating lever coupled to the plate members for moving the jaws from an open position to a nail cutting position.

In order to accomplish the nail cutting operation, conventional nail clippers include a hook member of cylindrical shape which is coupled to a front side of the first and second plate members and to which the operating lever is engaged to provide a leverage action to cut nails inserted between the jaw members. More specifically, the cylindrical hook member includes a hooking groove formed at an upper side of the hook member, and a front tip portion of the operating layer is engaged to the hooking groove to carry out the leverage action magnifying the cutting force of the jaws. Since such nail clippers have a single hooking groove, the gap between the upper and lower jaws of the conventional nail clippers is set to a fixed size depending on the design of the nail clippers. Thus, common nails clippers have a limited gap size, and they cannot effectively be used to cut nails of greater thickness, such as abnormally grown finger or toe nails, thicker toe nails, and toe nails grown excessively or deformed greatly. Consequently, it is necessary to use another nail clipper of bigger size with a bigger gap size to cut such nails of greater thickness, and thus, requiring multiple nail clippers to cover the necessary thickness range of their nails.

SUMMARY OF THE INVENTION

Accordingly, the present invention has been made to solve the above-mentioned problems or shortcomings occurring in the prior art nail clippers, and the present invention is contemplated to provide a nail clipper which is reliable and durable in structure, while also allowing the user to easily adjust the cutting gap of the nail clipper by simple gap adjusting operation.

The nail clipper of the present invention utilizes a hook member having a specially designed shape to easily realize the gap adjusting operation by the user, and the front portion of the operating layer of the nail clipper has a specially configured structure enabling its coupling function with the hook member for nail cutting operation and the gap adjusting operation as well.

Accordingly, the nail clipper of the present invention can be used to cover a wide thickness range of people's nails, including nails of small or normal thickness, as well as the nails of greater thickness or abnormal shape such as deformed or bent nails, only with simple gap adjusting operation that can be easily performed by an average layperson without difficulty.

According to one preferred embodiment of the present invention, the nail clipper comprises:

a clipper body having first and second clipper body members, said first and second clipper body members each having a matching jaw portion at a front side thereof for clipping operation;

an operating lever configured to move said match jaw portions to cut a nail inserted between said matching jaw portions; and a hook member mounted to a front area of the first and second clipper body members, said hook member having a cylindrical shaft portion with a hooking groove formed at an upper area of the cylindrical shaft portion, wherein said hooking groove includes a vertical groove portion extending vertically downwardly from an upper end of the cylindrical shaft portion, a first lateral groove portion extending in a lateral direction from the vertical groove, a second lateral groove portion extending in another lateral direction from the vertical groove, the first lateral groove portion formed below the second lateral groove portion, wherein the operating lever includes a lever body portion, and a tip portion extending in an angled or inclined direction from the lever body, said tip portion having a coupling hole formed there-through and defining a front tip portion at a front side of the coupling hole, wherein said front tip portion of the operating lever is shaped and configured to be inserted through the vertical groove portion of the hook member and to couple with a selected one of the first and second lateral groove portions of the hook member to set a desired gap size of the matching jaw portions of the clipper body.

Preferably, the first lateral groove portion of the hook member extends in a diagonally upward direction, with inclination of 15-75 degree, orienting toward a rear end of the nail clipper when it is assembled, and the second lateral groove portion extends in a diagonally upward direction, with inclination of 15-75 degree, orienting toward a front end of the nail clipper when it is assembled. It is also preferable that the coupling hole of the operating lever has a generally D-shape, or a rectangular or track-shape with two opposing parallel sides.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE INVENTION

Figure 1:
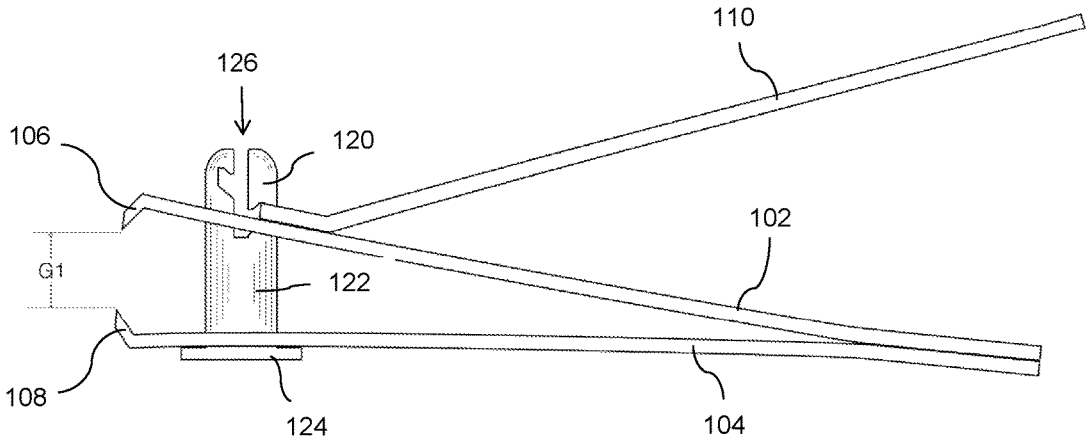
FIG. 1 is a side view of the nail clipper according to a preferred embodiment of the present invention, with the gap of the upper and lower jaws set to have a normal gap.

Referring to the drawings, the nail clippers of the present invention are described herein in detail in association with exemplary or currently preferred embodiments thereof. However, the following descriptions of such embodiments are intended primarily for illustrating the principles and exemplary constructions of the nail clippers of the present invention, and the present invention is not specifically limited to these exemplary embodiments. Thus, one skilled in the art can appreciate or recognize that various modifications and substitutions can be made thereto without departing from the spirit and scope of the present invention. Throughout the disclosure, the same or similar elements and portions thereof are referred and described with the same reference characters for the simplicity and illustrative purposes.

Figure 2:
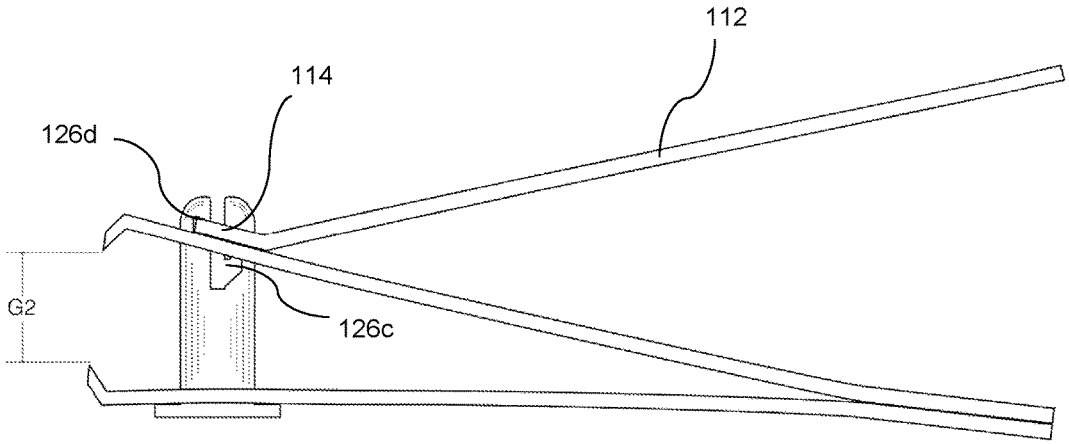
FIG. 2 is a side view of the nail clipper of FIG. 1, with the gap of the upper and lower jaws set to have a wide gap.

With reference to FIGS. 1 and 2, the nail clipper according to one preferred embodiment of the present invention is described herein below. As depicted in the drawings, the nail clipper includes a first clipper body member 102 and a second clipper body member 104 coupled together at a rear end (e.g., a right end in the drawings shown) by a pin member or other known coupling elements (not shown), such as pins, rivets, coupling screws, and the like. The body members 102 and 104 have a first cutting jaw 106 and a second cutting jaw 108, respectively, at a front end thereof, and are configured to cut nails in cooperation with an operating lever (to be described below) upon operation. These body members 102 and 104 are configured such that the cutting jaws 106 and 108 are normally in a spaced apart relationship, and can be moved into a cutting position as the user operates the nail clipper.

For clipping operation, the nail clipper 100 includes an operating lever 110 connected to a pin or hook member 120 which extends through a set of bores formed at the front end portion of the first and second clipper body members 102 and 104. The hook member 120 includes a cylindrical shaft 122 for coupling to the bores of the clipper body members, and a flange 124 for abutting the bottom surface of the second clipper body member 104 as shown. In cutting operation, the frontal tip area of the lever 110 contacts the upper surface of the first body member 102 to provide a leverage effect, and is capable of operating the jaw portions to move towards each other to cut or trim a desired object (e.g., finger nails or toe nails) inserted between the jaw portions.

Figure 3:
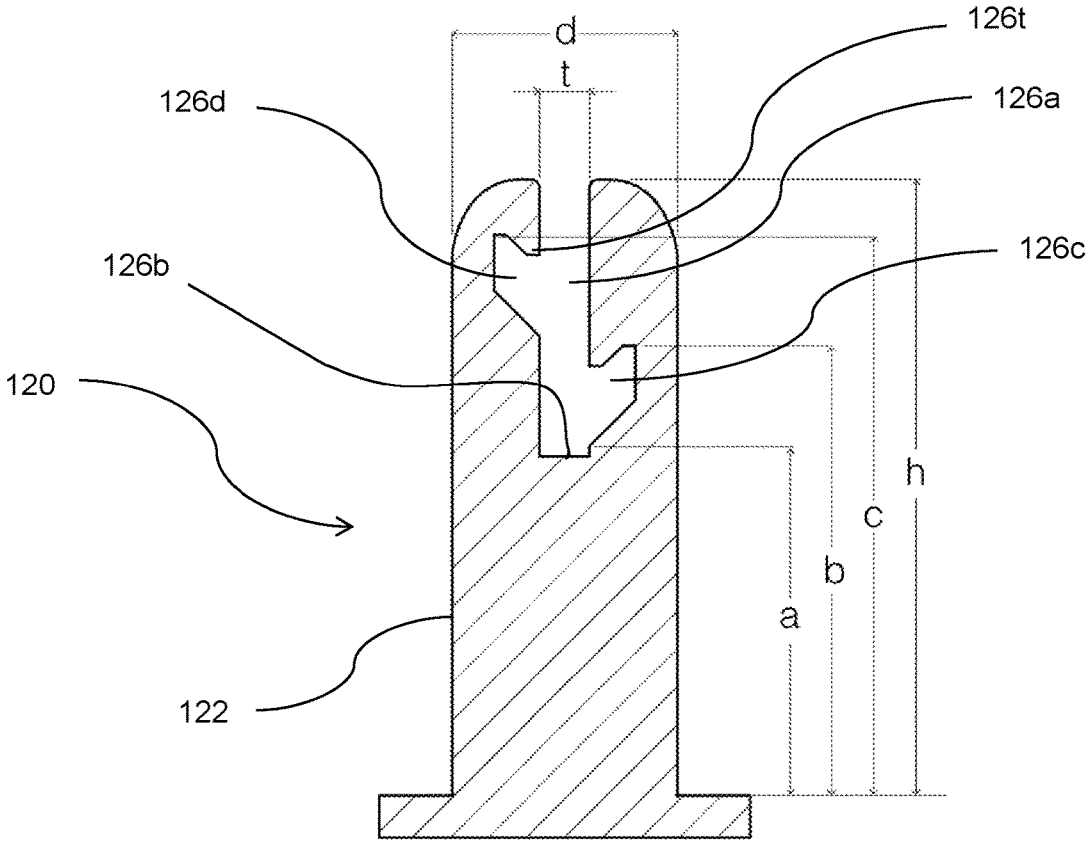
FIG. 3 is an enlarged sectional view illustrating the structure of the hook member of FIGS. 1 and 2, with the section taken along a longitudinal axis of the hook member.
Figure 4:
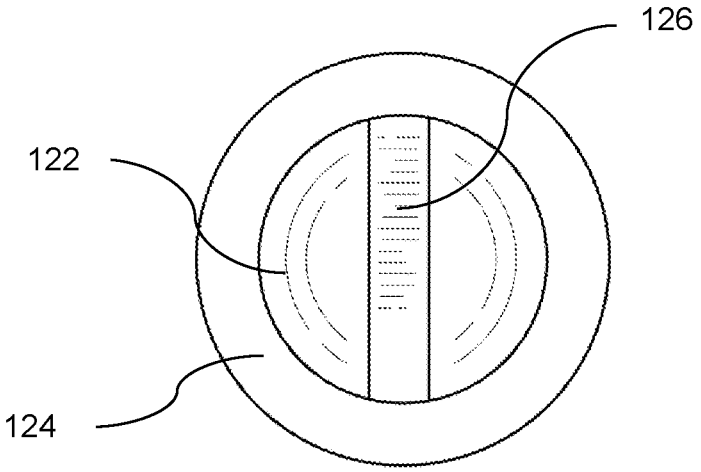
FIG. 4 is a top plan view of the hook member of FIG. 3.

The hook member 120 is formed preferably of metallic or composite materials, and includes a hooking groove 126 with specially designed groove configuration for enabling the gap adjustment operation to adjust the gap of the cutting jaws 106 and 108 by the user, and a distal tip of the lever 110 is engaged to the hooking groove 126 in a manner to be described below. As specifically shown in FIG. 3, the hooking groove 126 includes a vertical groove portion 126*a* extending vertically downwardly from the upper surface of the hook member 120 to the groove end face 126*b*, a first lateral groove portion 126*c* extending in a lateral direction from the vertical groove portion 126*a*, and a second lateral groove portion 126*d* extending in a lateral direction from the vertical groove portion 126*a*. According to the preferred embodiment as shown in the drawings, the first lateral groove portion 126*c* extends in a diagonally upward direction (preferably with inclination of 15-75 degree) orienting toward the rear end of the nail clipper when assembled, and the second lateral groove portion 126*d* extends in a diagonally upward direction (preferably with inclination of 15-75 degree) orienting toward the front end of the nail clipper when assembled, as shown in FIGS. 1 and 2. However, it is specifically noted that the shapes and extending directions of the first and second lateral groove portions are not limited thereto. For example, the first and second lateral groove portions 126*c* and 126*d* may extend in a horizontal direction, or in a diagonally upward direction with inclination less than 15 degree (°).

The dimension of the hook member 120 as well as the length and width of the groove portions 126*a*, 126*c*, and 126*d* are selected to provide multiple gap sizes (e.g., a normal gap G1 and a wider gap G2) between the jaws 106 and 108 to be in a suitable range to cover a normal thickness and a wider thickness of the nails of the users. More specifically, the cylindrical shaft 122 has a diameter "d" which is preferably in a range from 1/8 inch to 6/16 inch, and each of the vertical groove portion 126*a* and the lateral groove portions 126*c* and 126*d* has a groove width "t" which is preferably in a range from 1/32 inch to 3/32 inch. The length "h" from the upper surface of the flange 124 to the upper tip of the cylindrical body 122 is preferably in a range from 7/16 inch to 15/16 inch, The length "a" from the upper surface of the flange 124 to the groove end face 126*b* is preferably in a range from 1/4 inch to 1/2 inch, and the length "b" from the upper surface of the flange 124 to the upper tip of the first lateral groove portion 126*c* is preferably in a range from 6/16 inch to 10/16 inch, and the length "c" from the upper surface of the flange 124 to the upper tip of the second lateral groove portion 126*d* is preferably in a range from 8/16 inch to 12/16 inch.

Figure 5:
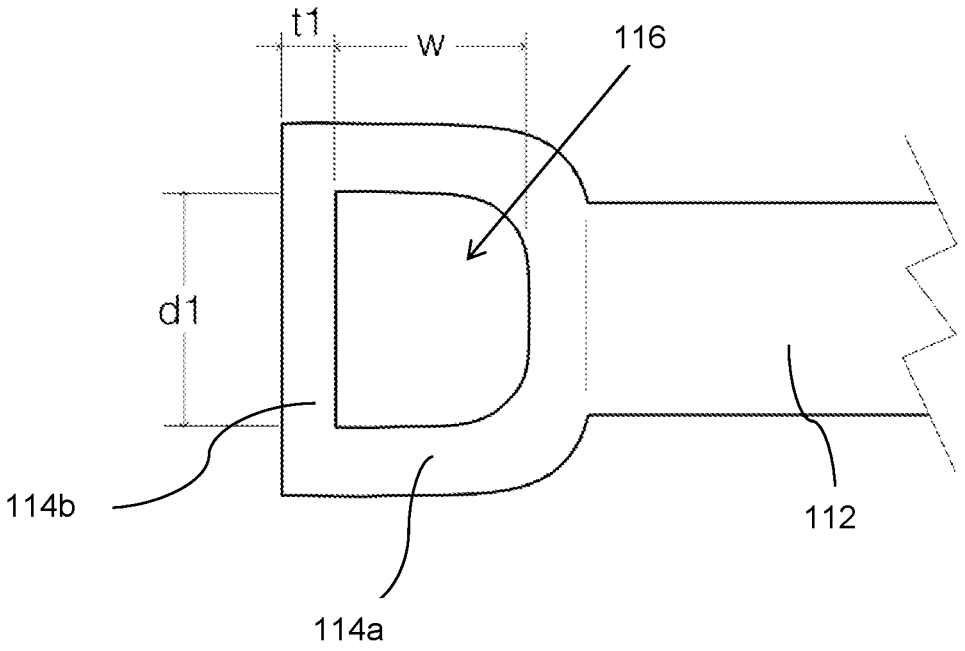
FIG. 5 is an enlarged plan view illustrating a distal portion of the operating lever of FIGS. 1 and 2.

The operating lever 110 is formed preferably of a thin metallic material, and includes a lever body portion 112 onto which a thumb of the user is placed to hold and operate the nail clipper, and a tip portion 114 extending in an angled or inclined direction from the lever body 112. As shown in FIG. 5, the tip portion 114 includes a pair of opposing rim or circumferential portions 114*a* and a front bar portion 114*b*, and thereby, defining therein a coupling hole 116 of generally D-shape, or rectangular, or track-shape with two opposing parallel sides. The front bar portion 114*b* is formed into a generally linearly extending bar or similar shape, and has a dimension (e.g., width and thickness) suitable for slidably inserting and coupling to the vertical groove portion 126*a* as well as lateral groove portions 126*c* and 126*d*. According to one preferred embodiment, the front bar portion 114*b* has a width "t1" and a thickness about the same or slightly smaller than the width "t" of the groove portions 126*a*, 126*c*, 126*d* of the hook member 120. Thus, the front bar portion 114*b* of the lever 110 can be slidably inserted to the vertical groove 126*a*, then into a selected one of the lateral grooves 126*c* and 126*d* for coupling thereto upon selection of the user. The D-shaped (or generally rectangular) coupling hole 116 of the lever has a diameter "d1" (i.e., the distance between two parallel rims 114*a*) which is about the same or slightly larger than the diameter "d" of the cylindrical shaft 122, and a width "W" which is about the same or slightly smaller than the diameter "d" of the cylindrical shaft 122 in light of the required allowance enabling the cylindrical shaft 122 to be displaced within the coupling hole 116 during the gap adjustment operation for moving the position of the operating lever 110 by the user.

In order to initially assemble the nail clipper into a first position having a normal (or smaller) gap size "G1" with the frontal tip of the lever 110 coupled to the first lateral groove portion 126*c*, the user first aligns the front bar portion 114*b* of the operating lever with the vertical groove portion 126*a* of the hook member 120, and pushes the tip portion to slide downwardly along the vertical groove and against the first clipper body member which is elastically biased upwardly, while pulling the lever 120 in a rearward direction toward the rear side of the clipper. This causes the front bar portion 114*b* to engage with the first lateral groove portion 126*c* when the front bar portion 114*b* is aligned with the first lateral groove portion 126*c*. As such, the users can easily assemble the lever 110 to the hook member 120 of the nail clipper with a normal or smaller clipper gap (G1), and the frontal tip of the lever 110 is securely coupled to the first lateral groove portion 126*c*, as shown in FIG. 1. Here, as the frontal tip of the lever 110 is tightly caught in the first lateral groove portion 126*c* (see FIG. 1) due to the upwardly-biasing spring force of the first clipper body member 102, it cannot easily escape therefrom unless the user applies a sufficient force to the operating lever 110 in a frontward direction (that is, leftward in the drawings) to move the front tip of the lever 110 out of the groove while pressing the first clipper body member 102 downward against its elastic spring force. In this manner, the nail clipper can be readily assembled to have a first gap size (G1) to cut nails having normal or smaller thicknesses, and it can reliably be used without the risk of accidental disassembling.

To the contrary, in order to assemble the nail clipper into a second position having a larger gap size "G2" with the frontal tip of the lever 110 coupled to the second lateral groove portion 126*d*, the user first aligns the front bar portion 114*b* of the operating lever with the vertical groove portion 126*a* of the hook member 120, and pushes the tip portion to slide downwardly along the vertical groove against the first clipper body member which is elastically biased upwardly, while also pushing the lever 120 in a frontward direction toward the front side of the clipper. This causes the front bar portion 114*b* to engage with the second lateral groove portion 126*d* when the front bar portion 114*b* is aligned with the second lateral groove portion 126*d*. As such, the users can easily assemble the lever 110 to the hook member 120 of the nail clipper with a wider clipper gap (G2) and the frontal tip of the lever 110 is securely coupled to the second lateral groove portion 126*d*, as shown in FIG. 2. Here, as the frontal tip of the lever 110 is caught in the second lateral groove portion 126*d* (see FIG. 2) with a protruded tip "126*t*" (see FIG. 3) engaging to the coupling hole 116 of the front bar portion 114*b* as the first clipper body member 102 applies the upwardly-biasing spring force, the frontal tip of the lever 110 cannot easily escape from the second lateral groove portion 126*d* unless the user applies a sufficient force in a rearward direction (that is, rightward in the drawings) to move the front tip of the lever 110 out of the groove while pressing the first clipper body member 102 downward against its elastic spring force. In this manner, the nail clipper can be readily assembled to have a second gap size (G2) to cut nails having larger thicknesses, and it can reliably be used without the risk of accidental disassembling.

In addition, the users can also easily change the gap size of the nail clipper between the normal/smaller size (G1) and the wider size (G2) whenever desired, by first unlocking the front bar portion 114*b* out of the currently coupled one of the first and second lateral grooves, and then shifting to engage with the other lateral groove which is free. For example, in order to unlock and shift the engagement from the first lateral groove 126*c* of normal/smaller size (G1) to the second lateral groove 126*d* of wider size (G2), the user needs to push the operating lever 110 in a front ward direction to unlock the operating lever 110 from the first groove 126*c*, and leaves the front bar portion 114*b* to engage to the second groove 126*d* with the aid of the elastic spring force of the first clipper body member 102. Likewise, in order to unlock and shift the engagement from the second lateral groove 126*d* of wider size (G2) to the first lateral groove 126*c* of normal/smaller size (G1), the user needs to pull the operating lever 110 in a rearward direction to unlock the operating lever 110 from the second groove 126*d*, and presses the front bar portion 114*b* downward against the elastic spring force of the first clipper body member 10 to have the front bar portion 114*b* engaged to the first groove 126*c* 2. As such, the gap shifting operation can be performed by layperson without difficulties.

It is further noted that the operating lever 110 can be rotated between the operating position (shown in FIGS. 1 and 2) and the retracted or storing position with the operating lever 110 turned upside down (not shown) in such a manner similar to conventional nail clippers. This is enabled by pivotally rotating the hook member 120 by 180 degree using the operation lever 110 and then rotating the same upside down. Further detailed descriptions of this lever flipping feature is omitted herein, and one of ordinary skill in the art may readily recognize how this lever position conversion is possible upon examining the structures of the nail clipper of the present invention disclosed above, and further in view of the structures of well-known and readily available conventional nail clippers having similar lever flipping function.

As described above in connection with exemplary embodiments thereof, the present invention is contemplated to provide a nail clipper which is reliable and durable in structure, while also allowing the user to easily adjust the cutting gap of the nail clipper by simple gap adjusting operation to accommodate nails with a wide thickness range, both having smaller or normal thicknesses as well as larger thicknesses.

The above disclosed embodiments of the invention are representatives of a presently preferred form of the invention, but are intended to be illustrative rather than definitive thereof. Accordingly, those skilled in the art will appreciate or recognize that various modifications and substitutions can be made thereto without departing from the spirit and scope of the present invention as set forth in the appended claims.

What is claimed is:

1. A nail clipper comprising:

a clipper body having first and second clipper body members, said first and second clipper body members each having a matching jaw portion at a front side thereof for clipping operation;

an operating lever configured to move said match jaw portions to cut a nail inserted between said matching jaw portions; and a hook member mounted to a front area of the first and second clipper body members, said hook member having a cylindrical shaft portion with a hooking groove formed at an upper area of the cylindrical shaft portion, wherein said hooking groove includes a vertical groove portion extending vertically downwardly from an upper tip portion of the cylindrical shaft portion, a first lateral groove portion extending in a lateral direction from the vertical groove, a second lateral groove portion extending in another lateral direction from the vertical groove, the first lateral groove portion formed below the second lateral groove portion, wherein the operating lever includes a lever body portion, and a tip portion extending in an angled or inclined direction from the lever body, said tip portion having a coupling hole formed there-through and defining a front bar portion of the operating lever at a front side of the coupling hole, wherein said front bar portion of the operating lever is shaped and configured to be inserted through the vertical groove portion of the hook member and to couple with a selected one of the first and second lateral groove portions of the hook member to set a desired gap size of the matching jaw portions of the clipper body from among a narrower gap and a wider gap.

2. The nail clipper of claim 1, wherein the first and second lateral groove portions of the hook member extend in a diagonally upward direction from the vertical groove portion.

3. The nail clipper of claim 2, wherein the first lateral groove portion of the hook member extends in a diagonally upward direction, with inclination of 15-75 degree, orienting toward a rear end of the nail clipper, and the second lateral groove portion extends in a diagonally upward direction, with inclination of 15-75 degree, orienting toward a front end of the nail clipper.

4. The nail clipper of claim 1, wherein the front bar portion of the operating lever has a width approximately the same as or less than a width of the vertical groove portion and a width of the first and second lateral groove portions.

5. The nail clipper of claim 1, wherein the coupling hole of the operating lever has a generally D-shape, or rectangular, or track-shape with two opposing parallel sides.

* * * * *